US005669940A

United States Patent [19]

Stubbs

[11] Patent Number: 5,669,940

[45] Date of Patent: Sep. 23, 1997

[54] ABRASIVE ARTICLE

[75] Inventor: Roy Stubbs, Nuneaton, England

[73] Assignee: Minnesota Mining and Manufacturing Company, St. Paul, Minn.

[21] Appl. No.: 512,799

[22] Filed: Aug. 9, 1995

[51] Int. Cl.[6] ..... B24D 3/02; B24D 3/20

[52] U.S. Cl. ..... 51/295; 51/306; 156/279

[58] Field of Search ..... 51/295, 306; 156/279

[56] References Cited

U.S. PATENT DOCUMENTS

| | | | |
|---|---|---|---|
| 3,763,604 | 10/1973 | Malloy | 51/293 |
| 3,872,629 | 3/1975 | Malloy | 51/295 |
| 4,027,435 | 6/1977 | Malloy . | |
| 4,144,219 | 3/1979 | Malloy | 260/33.8 |
| 4,336,293 | 6/1982 | Eiden . | |
| 4,525,177 | 6/1985 | Grimes et al. . | |
| 4,554,765 | 11/1985 | Grimes et al. | 51/298 |
| 4,960,844 | 10/1990 | Singh . | |
| 4,997,717 | 3/1991 | Rembold et al. . | |
| 5,213,589 | 5/1993 | Ronning et al. . | |
| 5,250,085 | 10/1993 | Mevissen . | |
| 5,296,561 | 3/1994 | Babu et al. . | |
| 5,436,063 | 7/1995 | Follett et al. . | |
| 5,451,446 | 9/1995 | Kincaid et al. | 428/143 |

FOREIGN PATENT DOCUMENTS

| | | | |
|---|---|---|---|
| 0 202 491 A2 | 11/1986 | European Pat. Off. | C08L 67/00 |
| 0 326 704 | 8/1989 | European Pat. Off. . | |
| 0 344 912 | 12/1989 | European Pat. Off. . | |
| 0 370 464 | 5/1990 | European Pat. Off. . | |
| 0 577 951 | 1/1994 | European Pat. Off. . | |
| 35 15 923 | 11/1986 | Germany . | |
| 35 18 357 A1 | 11/1986 | Germany | C09L 3/16 |
| 37 02 242 A1 | 9/1987 | Germany | C30B 25/02 |
| 3-149277 | 6/1991 | Japan | C09J 133/10 |
| 4-114078 | 4/1992 | Japan | C09J 133/04 |
| 4-202585 | 7/1992 | Japan | C90J 133/06 |
| 851844 | 10/1960 | United Kingdom . | |
| 2 070 637 | 9/1981 | United Kingdom . | |
| 2 197 326 | 5/1988 | United Kingdom . | |
| 2 237 022 | 4/1991 | United Kingdom . | |
| 2 282 144 | 3/1995 | United Kingdom . | |
| WO 95/11111 | 4/1995 | WIPO . | |

OTHER PUBLICATIONS

Derwent Abstract of Japanese Patent 6–023675 (Feb. 1, 1994).

Derwent Abstract of Japanese Patent 2–286773 (Nov. 26, 1990).

Chemical Abstracts 85:64328a, vol. 85, p. 71 (1976).

*Primary Examiner*—Deborah Jones

*Attorney, Agent, or Firm*—Gary L. Griswold; Walter N. Kirn; Doreen S. L. Gwin

[57] ABSTRACT

An abrasive article comprising a substrate having a first major surface and an adhesive layer having abrasive particles embedded therein coated on the first major surface of the substrate, the adhesive layer comprising a hot melt adhesive comprising a polymer cross-linked via hydrolyzed or condensed silyl groups; and a method of preparing an abrasive article, the method comprising (a) providing a substrate having a first major surface, (b) applying an adhesive layer comprising a moisture-curable hot melt adhesive comprising a polymer having hydrolysable or condensable silyl groups to the first major surface of the substrate, the hot-melt adhesive being in a molten or semi-molten state, (c) depositing abrasive particles on the adhesive layer, and (d) curing the hot-melt adhesive.

43 Claims, No Drawings

ABRASIVE ARTICLE

FIELD OF THE INVENTION

This invention relates to an abrasive article comprising a cured hot melt adhesive and to a method of preparation.

BACKGROUND OF THE INVENTION

Abrasive products are normally prepared by coating one surface of a substrate with a first binder layer having adhesive properties, often referred to in the art as the "make". Particles of abrasive material are applied to the coated substrate and partially embedded therein. A layer of a second binder, often referred to as the "size", is then applied to the material. The thickness of the second binder layer regulates the amount of the abrasive material extending above the binder medium. Anti-loading or anti-static materials having generally been included in a further optional layer, referred to in the art as the "supersize".

The adhesives used to form the make are generally water- or solvent-based and include phenolic resins, urea-formaldehyde, melamine-formaldehyde and combinations thereof. Other adhesive which have been used are based on animal hide glue and starch. Similar adhesives have been used for the size.

Many of the known adhesive systems which have been used are of low solids content requiring a high energy input for drying and the careful selection of backing materials. In the case of solvent-based adhesives, apparatus to extract solvent emissions may also be needed. Such extraction apparatus may also extract the fines from the abrasive particles leading to processing problems.

British Patent No. GB 2,282,144, discloses an abrasive element comprising a substrate bearing layer of a moisture-cured hot melt polyurethane adhesive having abrasive particles embedded therein.

It has been found that the use of a moisture-cured hot melt polyurethane adhesive as the make in an abrasive element provides a number of advantages over traditional water- and solvent-based systems. The hot melt adhesive is used at 100% solids content and by suitable selection of the application temperature will maintain the desired orientation of the abrasive particles. The hot melt adhesive is compatible with many size formulations and allows the application of water-based size over the make and abrasive particles, the moisture content of the size participating in the curing of the make adhesive ensuring strong bonding between the make and the size. Other sizes may be employed, e.g., hot melt or solvent-based formulations, and may be applied before or after curing the make adhesive coating.

Hot melt adhesives are 100% solid polymeric materials which form bonds on cooling. They are generally composed of a combination of resins, waxes and stabilizers. Coating is normally by die coating or extrusion, but can also be by spray coating. Moisture-cured polyurethane coatings comprise isocyanate-terminated prepolymers which, after application, are cured by reaction of the residual isocyanate groups with moisture. The amino groups initially formed react with more isocyanate groups to form urea linkages.

The moisture curing hot melt polyurethane (HMPU) may be applied to any substrate which will withstand the application temperature of the adhesive. The HMPU may be coated directly on the substrate or a priming or presize layer may be applied prior to its application. These priming or presize layers may be solvent-based, water-based or hot melt. The priming or presize layer is conveniently hot melt since it may readily be applied at the same coating station as the HMPU make. Priming or presize layers are particularly useful on substrates which have rough surfaces or surfaces with voids e.g., open-cell foams, and woven and nonwoven fabrics, since it assists in smoothing the surface and reduces the amount of HMPU required for the make, which tends to be a more expensive component than the presize material. Priming or presize layers are not normally required on closed-cell foams and other substrates having a substantially sealed surface.

Moisture-curing hot melt adhesives in which the cure involves interactions of silyl groups are known in the literature, and some are available commercially. Such materials can be totally free of isocyanates, as described in GB 2237022, WO 92/05226, GB 2197326, EP 0202491, U.S. Pat. No. 4,960,844 and Japanese Published Application Nos. 4-202585, 4-114078. and 3-149277. Moisture-curing hot melts containing both isocyanate and silyl groups have also been disclosed.

SUMMARY OF THE INVENTION

The present invention utilizes alternative hot melt adhesives not requiring the use of isocyanates in the preparation of abrasive elements.

One aspect of the present invention relates to an abrasive article comprising a substrate comprising a first major surface, an adhesive layer on said first major surface of said substrate; said adhesive layer comprising a hot melt adhesive comprising a polymer cross-linked via hydrolyzed or condensed silyl groups and abrasive particles adhered therein.

DETAILED DESCRIPTION OF THE INVENTION

The adhesive used in the present invention is a 100% solids resinous formulation which melts to a fluid state at elevated temperatures (e.g., in the range 50° to 200° C.). At the fluid state, the adhesive may be coated on a substrate by conventional techniques such as extrusion, die coating, spraying etc. On cooling to ambient temperatures, the adhesive solidifies and further cures to a cross-linked three-dimensional network via the mutual interaction of silyl groups incorporated in the resin, the curing reaction being activated by moisture.

Abrasive articles of the invention may be manufactured by coating a surface of a suitable substrate with the hot melt adhesive as described above, and applying abrasive particles to the molten or semi-molten adhesive coating so that they become adhered therein. The application of abrasive particles may be, for example, by drop coating or electrostatically coating the particles, both of which are standard techniques in the abrasives industry. The thickness of the adhesive coating and the dimensions of the particles are preferably such that most if not all of the particles partially project above the surface of the coating. As the adhesive cools, it solidifies completely and cures to a three-dimensional network, and hence bonds the particles firmly to the substrate.

The substrate may comprise any of the materials commonly used as the backing for coated abrasive articles, including paper, cloth, plastic films, plastic fibers, fibrous bases, woven and nonwoven webs/fabrics, foams, foamed polymeric materials, and laminates etc. The substrate, as described above, optionally may be precoated with a suitable resin ("presized") in order to seal the surface, for example, or otherwise modify its surface properties. A pre-size may be beneficial in the case of porous materials and/or irregular surfaces, as in open cell foams, nonwoven webs etc.

Suitable presizes may be applied as solvent- or water-based formulations, or as 100% solids hot melt formulations. Hot melt formulations are preferred and examples include a hot melt ethylene vinyl acetate commercially available from Evode, Stafford, Staffordshire, United Kingdom, under the trade designation "Thermaflow 6876"; a hot melt polyethylene commercially available from Minnesota Mining and Manufacturing Company, St. Paul, Minn., under the trade designation "3748"; a hot melt polyamide commercially available from Minnesota Mining and Manufacturing Company, St. Paul, Minn., under the trade designation "3789". In some circumstances, a pre-formed plastic film may be applied to the substrate, which is a useful option where the substrate is an open cell foam, or a woven or non-woven fabric.

The abrasive article may additionally comprise a size layer. The size layer may comprise any of the materials conventionally used, but preferably comprises a thermosetting resin (e.g., phenol-formaldehyde or urea-formaldehyde) in the form of an aqueous solution or dispersion, coated and cured according to conventional techniques. The water from such a coating serves to activate the curing reaction in the adhesive layer, while the thermosetting resin provides additional strength and controls the degree to which the abrasive particles project above the surface. Suitable size materials include a water-based acrylic commercially available from Evode, Stafford, Staffordshire, United Kingdom, under the trade designation "DP-90-4101"; water-based polyurethanes commercially available from Baxenden, Droitwich, Worcestshire, United Kingdom, under the trade designation "Witcobond 732", "Witcobond 769" and "Witcobond 788". Other sizes may be employed, e.g., hot melt or solvent-based formulations, which may be applied before or after curing the make adhesive coating. Additives such as anti-loading treatments, static control agents, etc., may be included in the size layer, or coated in a separate (supersize) layer, in accordance with known techniques.

The abrasive articles may also comprise a supersize, preferably antiloading supersize of the type disclosed in U.S. Pat. No. 5,164,265 and its equivalent, EP-0433031. Particularly preferred supersize compositions comprise calcium stearate and a fluorinated additive, e.g., a fluorinated additive commercially available from Minnesota Mining and Manufacturing Company, St. Paul, Minn., under the trade designation "FC396", in a water-based acrylic binder, e.g., a water-based acrylic binder commercially available from Vinamul, Carshalton, Surrey, United Kingdom, under the trade designation "Vinacryl".

The hot melt adhesives useful in the invention comprise a cross-linkable polymer having silyl groups represented by the formula:

$$—A—Si(R)_{3-m}(X)_m$$

in which:

A represents a divalent organic radical, preferably an optionally substituted alkylene, alkyleneoxy, alkylene-phenylene, or alkylene-oxyalkylene chain;

X represents a leaving group displaceable by hydrolysis, preferably a halogen atom, e.g., chlorine, or a group $R^1O$ or $R^1COO$ in which $R^1$ is a $C_{1-10}$, preferably $C_{1-4}$, alkyl or alkoxyalkyl group;

m is 1, 2, or 3, preferably 2 or 3; and

R represents a blocking group not displaceable by hydrolysis, for example, a $C_{1-4}$ alkyl group, a cycloalkyl of up to 8 carbon atoms, or an aryl group of up to 10 carbon atoms.

Such silyl groups are readily hydrolyzed by moisture (from the atmosphere or externally supplied) to from silanol groups Si—OH, which condense with one another to form —Si—O—Si— linkages as disclosed, for example, in WO 92/05226, corresponding to U.S. Pat. Nos. 5,227,442; 5,296,561; and 5,397,648.

The silyl groups are covalently bonded to one or more of the resin(s) constituting the hot melt adhesive. This may be achieved by grafting reactions carried out on a preformed polymer, or by copolymerization with suitable silane-functional monomers. Both approaches are fully documented in the literature, for example, GB 2237022 and WO 92/05226 (corresponding to U.S. Pat. Nos. 5,227,442; 5,296,561; and 5,397,648). In the resulting polymers, silyl groups are attached to about 0.1 to 20.0 mol% of the repeating units, more commonly about 0.3 to 5.0 mol%. The remaining repeating units may be derived from any of variety of monomers, such as alpha-olefins, acrylates and other vinyl compounds, as described in the prior art.

The hot melt adhesive may comprise additional resins, especially tackifying resins, in order to adjust the physical properties such as melt viscosity. The adhesive may also comprise a catalyst for the curing reaction, the preferred catalyst being an organotin compound or a titanate, such as dibutyltindilaurate or tetrabutyltitanate. Typical catalyst loadings are in the range 0.1 to 2.5% by weight based on the weight of total solids. In embodiments of the invention comprising an aqueous size coating, a catalyst may be unnecessary. Hot melt adhesives containing a cure catalyst optionally may be used in two-part form, with the catalyst and silane-functional resin supplied separately and mixed immediately prior to coating or during the coating process e.g., by extrusion through adjacent dies.

A commercially available hot melt adhesive suitable for use in the invention was supplied by Swift Adhesives Ltd., Twickenham, United Kingdom, under the trade designation "X200/9". One method for preparing this adhesive is believed to be as follows: combining a silane grafted copolymer in an amount of about 15 parts by weight; a hydrogenated alicylic hydrocarbon-solid midblock compatible tackifying resin available from Exxon Chemical Company, Houston, Tex., under the trade designation "Escorez 5380" in an amount of about 40 parts by weight; polybutene-liquid mid-block compatible plasticizer available from BP Chemicals, Cleveland, Ohio, under the trade designation "Hyvis 30" in an amount of about 45 parts by weight; a catalyst masterbatch (1% by weight dibutyl tin dilaurate in ethylene vinyl acetate) in an amount of about 1.7 parts by weight; and an antioxidant available from Ciba Geigy, Ardsley, N.Y., under the trade designation "Irganox 1010" in an amount of about 1 part by weight.

The silane grafted copolymer (i.e., a silane grafted styrene ABA block copolymer) can be prepared as follows: 100 parts by weight of a styrene-ethylene-butylene-styrene block copolymer available from Shell Chemical Company, Houston, Tex., under the trade designation "Kraton G1652" can be reacted with two parts by weight of vinyl trimethoxy silane using 0.17 parts by weight of dicumyl peroxide as a free radical generator and 0.5 parts by weight of an antioxidant available under the trade designation "Flectol H," from Monsanto. The reaction can be carried out in a PR46 Buss Ko-Kneader with the heater units set at 200° C./240° C./160° C. and the die heater at setting number 7. The material produced can be face cut and air cooled at an output rate of 5.2 kg per hour.

The composition can be homogenized prior to the addition of the catalyst. The catalyst can then be mixed in and the composition can be filled into a container for a hot melt adhesive applicator. A silica gel sachet may be placed in the filled container before it is sealed. This preparation is essentially as described in Example 3 of GB 2237022.

The hot melt adhesive used in a given application will be selected according to the particular requirements. As a general guide, hot melt adhesives having viscosities in the range 3,000 to 12,000 mPa.s (Brookfield) at 120° C. are suitable, but those exhibiting higher or lower values may be appropriate in certain circumstances. For example, a less viscous adhesive will normally be required if a lower coating temperature is to be used, and a more viscous adhesive may be suitable if a higher coating temperature can be tolerated.

The make coating is generally applied by heating the hot melt adhesive to a temperature at which the viscosity is suitable for coating and applying the molten material to the substrate by an extrusion die, or optionally two adjacent dies in the case of two-part composition. Coating temperatures depend upon the particular adhesive, but are generally in the range 50° to 200° C., usually in the range 120° to 160° C. The coating weight depends upon the surface of the substrate, the presence or absence of a presize, and the size of the abrasive particles. Coating weights are generally within the range 1 to 250 g/m$^2$, the lower end of the range being applicable to smooth substrates e.g., paper, and to the use of fine grade abrasive particles.

Hot melt size and presize coatings may be applied in a similar manner to the make coating.

The abrasive particles are generally applied to the coated substrate immediately after application of the adhesive e.g., by passing the substrate through a curtain of abrasive particles or by electrostatic coating. Preferably the abrasive particles are heated prior to application e.g., from 30° to 150° C. usually about 50° C.

Individual abrasive particles may be selected from those commonly used in the abrasive art, however, the abrasive particles (size and composition) can be chosen with the application of the abrasive article in mind. In choosing an appropriate abrasive particle, characteristics such as hardness, compatibility with the intended workpiece, particle size, reactivity with the workpiece, as well as heat conductivity may be considered.

The composition of abrasive particles useful in the invention can be divided into two classes: natural abrasives and manufactured abrasives. Examples of natural abrasives include: diamond, corundum, emery, garnet, buhrstone, chert, quartz, sandstone, chalcedony, flint, quartzite, silica, feldspar, pumice and talc. Examples of manufactured abrasive include: boron carbide, cubic boron nitride, fused alumina, ceramic aluminum oxide, heat treated aluminum oxide, alumina zirconia, glass, silicon carbide, iron oxides, tantalum carbide, cerium oxide, tin oxide, titanium carbide, synthetic diamond, maganese dioxide, zirconium oxide, and silicon nitride.

Abrasive particles useful in the invention typically and preferably have a particle size ranging from about 0.1 micrometer to about 1500 micrometers, more preferably ranging from about 0.1 micrometer to about 1300 micrometers. The abrasive particles preferably have an average particle size ranging from about 0.1 micrometer to about 700 micrometers, more preferably ranging from about 1 to about 150 micrometers, particularly preferably from about 1 to 80 micrometers. It is preferred that abrasive particles used in the invention have a Moh's hardness of at least 8, more preferably about 9; however, for specific applications, softer particles may be used.

The term "abrasive particle" includes agglomerates of individual abrasive particles. An abrasive agglomerate is formed when a plurality of abrasive particles are bonded together with a binder to form a larger abrasive particle which may have a specific particulate structure. The plurality of particles which form the abrasive agglomerate may comprise more than on type of abrasive particle, and the binder used may be the same as or different from the binders used to bind the agglomerate to a backing.

A size may be applied directly after application of the abrasive particles. The size is preferably water-based and may readily be applied by, e.g., spray-coating or roller-coating. The weight ratio of adhesive to 5 water is generally within the range 10:1 to 1:2, preferably from 1:1 to 2:1. The coating weight is generally in the range from 1 to 250 g/m$^2$ solids and is normally dependent on the grade of abrasive particles.

In absence of water-based size, the material may be sprayed with water or placed in a moist environment to cure the adhesive.

After application of size or water, the material is dried, e.g., by force drying in a tunnel oven with infrared heaters. Suitable drying temperatures are about 60° C. and drying times of about 90 seconds are usually sufficient.

Following drying, the abrasive article is preferably allowed to stand for a period of at least 24 hours to allow thorough curing.

A particularly preferred product in accordance with the invention is an abrasive sponge, e.g., a foam strip of thickness in the range 2 to 15 mm having abrasive particles coated on one major surface. The substrate coated with abrasive particles can be in sheet form or as a web from a roll. The sponge may be formed in situ in the apparatus upstream of the coating station. Foam blocks, e.g., of a thickness about 25 mm may also be coated with abrasive particles in accordance with the present invention.

The present invention is not limited to coating a single surface and articles having double sided abrasive coatings, which may be of different abrasive grades, may readily be prepared. Abrasive coating on some or all sides of a substrate is also possible.

The invention will now be illustrated by the following Examples.

EXAMPLE 1

A hot melt adhesive commercially available from Swift Adhesives Ltd., Twickenham, United Kingdom, under the trade designation "X200/9" was slot coated at about 140° C. onto paper at coating weights of 22, 32, and 48 grams per square meter, respectively.

Silicon carbide mineral of grade P220 (about 90 grams per square meter), commercially available from Arendal, Eydehavn, Norway, was drop coated on to the tacky, uncured coating at ambient temperature.

One sample of paper was drop coated after re-heating the adhesive to 160° C. for 60 seconds.

All samples showed sufficient adhesion of mineral to further coat with size.

A water-based urea/formaldehyde size mix commercially available from Dynochem, Duxford, Cambridgeshire, United Kingdom, under the trade designation "CBUL" was coated onto the samples described above. Drying/curing was effected for two hours at 80° C.

The abrasive grains in the abrasive layer of the resulting product(s) felt sharp. A brief cut test was performed as follows: A sample of the coated abrasive article was converted into a 5.0 cm×15 cm rectangular sheet and weighed. A dry brush and a sheet of paper were also weighed. The paper was larger than a wooden panel which was precoated with a water based acrylic lacquer commercially available from Granyte Surface Coatings PLC, Salford, England. The rectangular coated abrasive article was wrapped around a 5 cm×2.5 cm rubber block having about a 60 degree International Rubber Hardness. In a manual, hand-held, operation, the abrasive article on the rubber block was moved in push-pull strokes against the wooden panel sanding the acrylic lacquer. A stroke was the movement of the operator's hand in a straight line back and forth motion covering about 25 cm±5 cm in each motion. After 60 strokes, the brush was used to transfer any dust on the wooden panel to the paper. The weight of acrylic lacquer removed was determined by reweighing the coated abrasive, brush, and paper. In this manual test, 0.2 grams of acrylic lacquer was removed in 60 strokes which demonstrates the abrasiveness of a coated abrasive article in accordance with the present invention.

EXAMPLE 2

A polyester film was slot coated with a hot melt adhesive commercially available from Swift Adhesives Ltd., Twickenham, United Kingdom, under the trade designation, "X200/9" at about 140° C. using a coating weight of 40 grams per square meter.

Silicon carbide mineral of grade P220, commercially available from Arendal, Eydehavn, Norway, was drop coated onto the tacky, uncured coating at a mineral weight of 185 grams per square meter. A water-based phenol-formaldehyde resin was coated over as a size. Cure was effected at 115° C. for five hours.

I claim:

1. An abrasive article comprising a substrate having a first major surface and an adhesive layer having abrasive particles embedded therein coated on said first major surface of said substrate, the adhesive layer comprising a hot melt adhesive comprising a polymer cross-linked via hydrolyzed or condensed silyl groups.

2. The abrasive article as claimed in claim 1 wherein said silyl groups are represented by:

$$—A—Si(R)_{3-m}(X)_m$$

in which:

A represents a divalent organic radical,

X represents a leaving group displaceable by hydrolysis, m is 1, 2, or 3, and

R represents a blocking group not displaceable by hydrolysis.

3. The abrasive article as claimed in claim 2 in which A is a moiety selected from the group consisting of alkylene, alkylene-oxy, alkylene-phenylene and alkylene-oxy-alkylene, said moiety may be substituted or unsubstituted.

4. The abrasive article as claimed in claim 2 in which X is halogen, $R^1O$— or $R^1COO$—, wherein $R^1$ is a $C_{1-10}$ alkyl or alkoxyakyl.

5. The abrasive article as claimed in claim 2 wherein R is an alkyl, cycloalkyl, or aryl group.

6. The abrasive article as claimed in claim 2 wherein m is 2 or 3.

7. The abrasive article as claimed in claim 2 wherein said polymer comprises repeating units and said silyl groups are attached to from 0.1 to 20.0 mol % of said repeating units.

8. The abrasive article as claimed in claim 7 wherein repeating units other than said repeating units having silyl group attached are selected from alpha-olefins, acrylates and other vinyl compounds.

9. The abrasive article as claimed in claim 1 wherein the hot melt adhesive additionally comprises a catalyst.

10. The abrasive article as claimed in claim 9 wherein the catalyst is an organotin compound or a titanate.

11. The abrasive article as claimed in claim 10 wherein the catalyst is dibutyltinlaurate or tetrabutyltitanate.

12. The abrasive article as claimed in claim 1 wherein said abrasive layer is overcoated with a size layer.

13. The abrasive article as claimed in claim 12 wherein the size layer is a water-based coating.

14. The abrasive article as claimed in claim 12 wherein the size layer comprises acrylic, polyurethane, phenol, melamine or urea formaldehyde adhesive, a water based epoxy adhesive, or combinations thereof.

15. The abrasive article as claimed in claim 12 wherein the size layer comprises an acrylic binder and calcium searate.

16. The abrasive article as claimed in claim 12 wherein the size has a coating weight in the range of 1 to 250 $g/m^2$ solids.

17. The abrasive article as claimed in claim 12 further comprising a supersize.

18. The abrasive article as claimed in claim 17 wherein the supersize comprises a binder and calcium stearate.

19. The abrasive article as claimed in claim 1 further comprising a presize layer between the substrate and the hot melt adhesive.

20. The abrasive article as claimed in claim 19 wherein the presize layer comprises a hot melt adhesive.

21. The abrasive article as claimed in claim 19 wherein the presize layer comprises ethylene vinyl acetate, polyethylene or polyamide.

22. The abrasive article as claimed in claim 1 wherein the hot melt adhesive has a coating weight in the range of 1 to 250 $g/m^2$.

23. The abrasive article as claimed in claim 1 wherein the substrate is selected from paper, plastic fibers, fibrous bases, woven and non-woven fabrics, foams, and laminates thereof.

24. The abrasive article as claimed in claim 23 wherein the substrate is a sponge sheet having a thickness in the range of 2 to 15 mm.

25. A method of preparing an abrasive article, the method comprising (a) providing a substrate having a first major surface, (b) applying an adhesive layer comprising a moisture-curable hot melt adhesive comprising a polymer having hydrolyzable or condensable silyl groups to said first major surface of said substrate, said hot-melt adhesive being in a molten or semi-molten state, (c) depositing abrasive particles on said adhesive layer, and (d) curing said hot-melt adhesive.

26. The method as claimed in claim 25, wherein said silyl groups are represented by:

$$—A—Si(R)_{3-m}(X)_m$$

in which:

A represents a divalent organic radical,

X represents a leaving group displaceable by hydrolysis, m is 1, 2, or 3, and

R represents a blocking group not displaceable by hydrolysis.

27. The method as claimed in claim 25 wherein said adhesive is heated to a temperature of from 50 to 250° C. prior to application.

28. The method as claimed in claim 27 wherein said adhesive is heated to a temperature of about 140° C.

29. The method as claimed in claim 25 wherein said adhesive is applied having a coating weight in the range of 1 to 250 g/m$^2$.

30. The method as claimed in claim 25 wherein said adhesive is applied as a one part composition.

31. The method as claimed in claim 25 wherein said adhesive is applied in two part form, one part comprising a silane functional resin and a second part comprising a catalyst.

32. The method as claimed in claim 31 wherein the silane functional resin and the catalyst are applied by extrusion through adjacent dies.

33. The method as claimed in claim 25 further comprising applying a size coat after applying the abrasive particles.

34. The method as claimed in claim 33 in which the size coat is water-based.

35. The method as claimed in claim 33 wherein the size coat comprises acrylic, polyurethane, phenol, melamine or urea formaldehyde adhesive, a water based epoxy adhesive, or combinations thereof.

36. The method as claimed in claim 33 wherein the size coat has a coating weight in the range of 1 to 250 g/m$^2$ solids.

37. The method as claimed in claim 25 further comprising applying a presize layer on the substrate prior to application of the hot melt adhesive.

38. The method as claimed in claim 37 wherein the presize layer comprises a hot melt adhesive which is applied in a molten state.

39. The method as claimed in claim 37 wherein the presize layer comprises ethylene vinyl acetate, polyethylene or polyamide.

40. The method as claimed in claim 25 wherein the substrate is selected from the group consisting of paper, plastics fibres, fibrous bases, woven and non-woven fabrics, foams, and laminates thereof.

41. The method as claimed in claim 40 wherein the substrate is a foam sheet having a thickness of about 5 mm.

42. The method as claimed in claim 25 wherein the abrasive particles are heated to a temperature of from 35° to 250° C. prior to depositing.

43. The method as claimed in claim 42 wherein the abrasive particles are heated to a temperature of about 50° C.

* * * * *